US006712532B2

(12) United States Patent
Look

(10) Patent No.: US 6,712,532 B2
(45) Date of Patent: Mar. 30, 2004

(54) METHOD OF PRINTING FILM AND ARTICLES

(75) Inventor: Thomas F. Look, Ham Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/288,396

(22) Filed: Nov. 5, 2002

(65) Prior Publication Data

US 2003/0099495 A1 May 29, 2003

Related U.S. Application Data

(60) Provisional application No. 60/332,885, filed on Nov. 5, 2001.

(51) Int. Cl.[7] ..... B41J 2/315

(52) U.S. Cl. ..... 400/120.01; 400/120.02; 400/120.03; 446/250; 156/557; 156/553; 428/352; 428/42.1; 347/171

(58) Field of Search ..... 400/120.01–120.03; 446/220; 156/557, 553; 428/352, 42.1; 347/171

(56) References Cited

U.S. PATENT DOCUMENTS

| | | | | |
|---|---|---|---|---|
| 4,268,117 A | | 5/1981 | Sevelin | |
| 4,505,967 A | | 3/1985 | Bailey | |
| 4,734,396 A | | 3/1988 | Harrison et al. | |
| 4,734,397 A | | 3/1988 | Harrison et al. | |
| 5,066,098 A | | 11/1991 | Kult et al. | |
| 5,139,996 A | | 8/1992 | Boyce et al. | |
| 5,254,525 A | | 10/1993 | Nakajima et al. | |
| 5,756,188 A | | 5/1998 | Reiter et al. | |
| 6,524,675 B1 | * | 2/2003 | Mikami et al. | 428/40.1 |
| 6,533,477 B2 | * | 3/2003 | Fukuda | 400/120.01 |

FOREIGN PATENT DOCUMENTS

| | | |
|---|---|---|
| EP | 0228835 | 7/1987 |
| EP | 0 419 241 | 3/1991 |
| EP | 0194106 | 2/1995 |
| EP | 0 656 264 | 6/1995 |
| EP | 0 782 931 | 7/1997 |
| EP | 0 900 669 | 3/1999 |
| JP | 9-290575 | 11/1997 |
| WO | WO 94/19710 | 9/1994 |
| WO | WO 94/19769 | 9/1994 |
| WO | WO 95/02515 | 1/1995 |
| WO | WO 96/24867 | 8/1996 |
| WO | WO 98/04418 | 2/1998 |
| WO | WO 00/68022 | 11/2000 |

OTHER PUBLICATIONS

Avery license plate sheeting no date.

* cited by examiner

*Primary Examiner*—Andrew H. Hirshfeld
*Assistant Examiner*—Andrea H. Evans
(74) *Attorney, Agent, or Firm*—Carolyn A. Fischer

(57) ABSTRACT

The present invention relates to a method of printing polymer films and corresponding articles. The invention is useful for providing dimensional stability during printing and/or improving the print quality, particularly for contact or thermal printing methods such as thermal mass transfer printing.

18 Claims, 1 Drawing Sheet

METHOD OF PRINTING FILM AND ARTICLES

RELATED APPLICATIONS

The application claim priority to provisional U.S. patent application Ser. No. 60/332,885 filed Nov. 5, 2001.

FIELD OF THE INVENTION

The present invention relates to a method of printing polymer films and corresponding articles. The invention is useful for providing dimensional stability during printing and/or improving the print quality, particularly for contact or thermal printing methods such as thermal mass transfer printing.

BACKGROUND OF THE INVENTION

There are several problems associated with printing on unsupported thin polymeric films. In general, thin films are less dimensionally stable and lack sufficient rigidity, causing such films to be difficult to handle and feed through a printer. Further, polymer films tend to carry very high static charges that attract dust particles causing void areas in the printed graphic. Thin polymer films also tend to be somewhat uneven in thickness in machine direction as well as in cross-web direction and have microscopic bumps and voids. These factors can cause uneven head pressure between the film and print head resulting in non-uniform colorant transfer.

In the case of thermal printing, and in particular thermal mass transfer printing, thin films typically conduct heat very rapidly, thus requiring higher levels of heat energy to effectively transfer the colorant from the ribbon to the receiving substrate. This increased temperature and/or increased contact time between the print head and thin polymer film, in turn can cause film wrinkling as well as reduced print head life. Wrinkling creates print voids in the creases of the wrinkles as well as misalignment of the film as it travels past the print head. The problems associated with heat-induced stresses are more pronounced in wider printers and printers with multiple heads.

Due to these aforementioned problems, unsupported thin polymer films often exhibit poor print quality when imaged by various printing techniques and in particular thermal printing methods as well as printing methods that involve contact between the image-receiving substrate and the print device such as in the case of thermal mass transfer printing.

Thin polymeric films are often used as top films in the construction of various commercial graphics films as well as various retroreflective sheeting for signage and other uses. In view of the problems associated with printing unsupported films, one approach is to print a dimensionally stable substrate, such as a thick polymeric film, optionally comprising an ink receptive layer. The topfilm may be mirror image printed and then bonded, typically by means of a permanent grade adhesive to a second substrate (e.g. retroreflective substrate) such that the printed surface layer is buried between the topfilm and the substrate. Alternatively, a dimensionally stable substrate may be image directly. A transparent topfilm or topcoat may then be applied to the viewing surface to protect the exposed print from environmental degradation. Another approach is to provide a construction (e.g. commercial graphic film) that comprises a thin polymeric film having a printable surface, optionally comprising an ink receptive layer. A pressure sensitive adhesive (PSA), covered with a release liner is provided on the surface of the film opposing the printable surface, resulting in a laminate having the PSA sandwiched between the film and the release liner. The exposed surface of the thin polymeric film of the laminate is then printed. During use the release liner is removed such that the pressure sensitive adhesive cleanly separates from the release liner, the adhesive remaining on the non-viewing surface of the printed film. The adhesive coated surface is then contacted to the target surface, such as a billboard backing.

SUMMARY OF THE INVENTION

Figure 1:
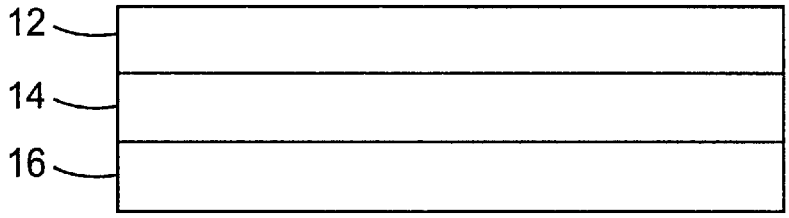
FIG. 1 depicts a laminate, according to the present invention wherein a film, 12 that is either dimensionally unstable or exhibits poor print quality, is provided above removable adhesive layer 14 bonded to a support 16.
Figure 2:
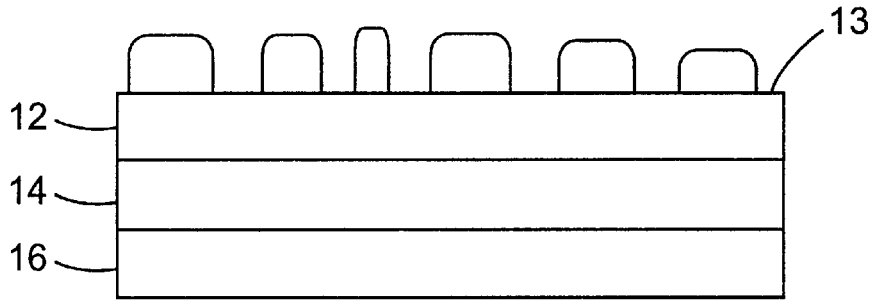
In FIG. 2, the surface 13 of the film opposing the removable adhesive layer further comprises a printed image 18. The surface 13 of the film may further comprise an ink receptive layer.
Figure 3:
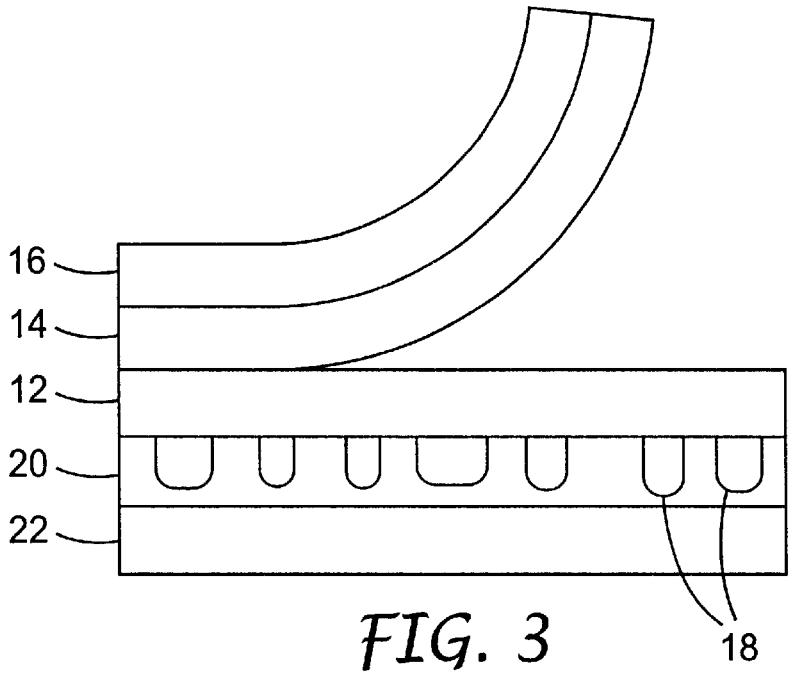
FIG. 3 depicts the printed surface being bonded to a substrate 22 with a permanent grade adhesive 20 such that the print is buried between the film 12 and the substrate 22. The support 16 together with the removable adhesive 14 is removed from the printed film and thus the finished article is substantially free of the removable adhesive coated liner.

In a preferred embodiment the invention relates to a method of printing comprising providing an image receiving sheet comprising a film having an exposed surface and an unexposed surface, a dimensionally stable support, and an adhesive disposed between said unexposed surface of the film and the support;

printing the exposed surface of the film;

bonding the exposed surface of the film to a substrate; and removing the support concurrently with removing the adhesive.

In another embodiment the method comprises providing an image receiving sheet comprising a dimensionally unstable film having an exposed surface and an unexposed surface, a dimensionally stable support, and a removable adhesive disposed between said unexposed surface of the film and the support; and printing the exposed surface of the film.

In another embodiment, the method comprises providing a polymer film that exhibits an initial print quality of less than 3, contacting the polymer film with a conformable layer that is bonded to a support; and thermal mass printing the polymer film.

In another embodiment an image-receiving sheet is disclosed comprising a dimensionally unstable film having an exposed surface and an unexposed surface, a dimensionally stable support, and a removable adhesive disposed between said unexposed surface of the film and the support.

In another embodiment an image-receiving sheet is disclosed comprising a film having an exposed surface and an unexposed surface wherein the exposed surface exhibits an initial print quality of less than 3, a dimensionally stable support, and a removable adhesive disposed between said unexposed surface of the film and the support; wherein the adhesive provides an improvement in print quality by at least one integer greater than the initial print quality.

For each embodiment, the method of printing is preferably contact printing and/or thermal printing, such as thermal mass transfer printing. The print quality of the dimensionally unstable film is preferably improved by at least one integer and more preferably by at least two integers according to the Print Quality Rating Scale. The dimensionally unstable film is preferably selected from the group comprising acrylic-containing films, poly(vinyl chloride)-containing films, poly(vinyl fluoride) containing films, urethane-containing films, melamine-containing films, polyvinyl butyral-containing films, polyolefin-containing films, polyester-containing films and polycarbonate-containing films. The film is preferably transparent, whereas the substrate to which the film is bonded may be transmissive, reflective or retroreflective. Further the film may further comprise an ink or dye receptive layer on the exposed surface of the film and/or a topcoat or second film disposed on the printed surface. The support is preferably substantially free of a release coating. The support may comprise paper or a polymeric film. The removable adhesive layer is typically preapplied to the support prior to mating the adhesive coated support to the dimensionally unstable film.

DESCRIPTION OF THE INVENTION

The methods of the present invention generally relate to providing an image-receiving sheet comprising a film, a support, and an adhesive disposed between the film and the support; and printing the exposed surface of the film. Although the film as well as the support could optionally comprise additional layers, such as primers for example, wherein the adhesive is disposed between the film layer and the support layer, it is preferred than the adhesive is directly bonded to the film and to the support. The exposed surface of the film (i.e. the surface opposing the surface adjacent to the adhesive layer) is ready for printing.

In a preferred embodiment, the method comprises the step of bonding the printed surface of the film to a substrate and removing the support concurrently with the adhesive. In such preferred embodiment, the finished article is substantially free of both the support and the adhesive.

Although the support as well as the substrate could also comprise a film, the terminology "film" as used herein refers to a polymeric material in the form of a continuous layer having a thickness of less than 4 mils. The film is preferably a thin polymer film having a thickness ranging from about 0.125 mils to about 3.5 mils and more preferably from about 0.25 mils to about 2 mils. The film typically has a minimum strength such that it can be wound into a roll. However, the film may also be derived from in-line extrusion film-forming techniques as well as by coating or casting a film precursor composition onto a release liner that subsequently cures (e.g. crosslinks) such as in the case of vinyl films.

The invention is particularly advantageous for imaging films that are dimensionally unstable. As used herein, "dimensionally unstable film" refers to a film that tends to wrinkle or misalign during printing unless supported by being temporarily or permanently bonded to a support such as a dimensionally stable substrate or release liner. Flexible polymer films that can be creased at 25° C. without any visible cracks tend to be dimensionally unstable.

Alternatively or in addition thereto, the invention is particularly advantageous for imaging films that when imaged in the absence of an underlying adhesive and support tend to exhibit poor print quality. Poor print quality refers to the physical property of exhibiting less than a "3" according to the print quality rating scale, described in further detail in the examples.

Unlike permanent grade adhesives and binder matrixes, such as used to embed glass bead optical elements in a retroreflective sheeting construction, the adhesive underlying the film layer is preferably a removable adhesive. Whereas substrates bonded with permanent grade adhesives or binders cannot be separated without damaging or destroying the substrates, the removable adhesive can be cleanly removed from the printed film without damaging the film. As used herein "removable adhesive" refers to any composition that exhibit such properties. The Applicant surmises that soft polymeric materials that may not typically be considered adhesives are also suitable for use.

Removable adhesives are characterized by relatively low tack and peel values. The peel values generally range from about 2 oz./linear inch to about 20 oz/linear inch according to a 90° peel to 304 Stainless Steel 2a as further described in ASTM D3330. Preferably, the peel value is at least 2 oz./linear inch. More preferably the peel value is less than about 15 oz./linear inch and most preferably less than about 10 oz./linear inch. In general, weaker tensile strength films generally prefer lower peel strength removable adhesives, whereas increasingly aggressive removable adhesives can be employed with higher tensile strength films.

The adhesive is generally conformable at ambient temperature, particularly in the case of contact print method. A preferred way of characterizing the conformability of the adhesive is to measure the elastic modulus, such method being further described in the forthcoming examples. In general, the adhesive has an elastic modulus of less than about 0.5 GPa at ambient temperature. The elastic modulus, is preferably less than 0.4 GPa, and more preferably less than 0.3 GPa. The elastic modulus is surmised to be at least about 0.005 GPa, and more preferably at least about 0.008 GPa. For printing methods that involve heat, the adhesive is preferably at least as conformable as just described at the print head temperature. For a universal removable adhesive layer that is suitable for ambient temperature printing as well as thermal printing, the adhesive preferably has a substantially flat elastic modulus curve as a function of temperature such that the elastic modulus is within the specified range at temperatures ranging from about 25° C. up to the maximum print heat temperature (e.g. 300° F.).

It is preferred than the adhesive exhibits relatively low thermal conductivity. Various polymeric materials that comprise elastomeric film-forming resins are typically good insulators. However, the thermal conductivity can be adjusted to some extent by altering the thickness of the adhesive layer.

The adhesive thickness of the removable adhesive layer can vary, provided that the adhesive layer contributes the desired conformability and is sufficiently removable from the film. In general, peel values tend to be related to coating weight thickness. Accordingly, increasingly aggressive removable adhesives are typically applied at lower coat weights, whereas less aggressive removable adhesives may be applied at higher coat weights. Typically, however, the removable adhesive coating weight ranges from about 1 grams/ft$^2$ to 10 grams/ft$^2$ with about 3 grams/ft$^2$ to about 5 grams/ft$^2$ being preferred. Although the removable adhesive is generally provided on the entire surface of the support, if desired the removable adhesive may be provided only beneath the film portions to be printed.

The adhesive composition is typically preapplied to the support. The support may also comprise a polymer film, yet is preferably paper. For embodiments wherein the film is dimensionally unstable, the support provides dimensionally stable, typically being substantially thicker than or comprised of a stiffer or more heat stable material (e.g. higher melt/softening point) in comparison to the film to be printed. The support does not substantially change in dimension when stressed from tension. Further in the case of thermal print methods, the support also does not substantially change in dimension when stressed with heat or combinations of tension and heat. However, the support need not be dimensionally stable with regard to tension and/or heat in substantial excess as would be present during printing.

The support in preferably electrically conductive to some extent in order to carry off static charges. Paper supports are preferred for this reason in that it is surmised that static charge is dissipated by water (e.g. vapor) that is present as a result of the paper manufacturing process or as a result of post absorption of water vapor.

The basis weight of suitable paper supports, prior to application of the removable adhesive, may range from about 20 to 60 lbs./ream and typically ranges from about 40 to about 45 lbs./ream. The dry tensile strength of suitable paper supports is typically at least about 5, more preferably at least about 10 and most preferably at least about 13 g/16 sheets. Further, the dry tensile strength is generally less than 50 g/16 sheets. The Elmendorf tear strength of suitable paper support is typically at least 25 g/16 sheets and is preferably greater than 40 g/16 sheets. Typically, the Elmendorf tear strength of paper supports is less than 100 g/16 sheets. Further, polymeric film generally have at least the equivalent strength of paper supports and generally considerably higher.

Unlike release liners, in preferred embodiments, the support preferably does not have a release coating such that the removable adhesive will cleanly remove from the support. Rather, the adhesive remains permanently bonded to the support such the adhesive is concurrently removed from the printed film upon subsequent stripping of the support.

The adhesive is typically applied directly to the support with any suitable coating technique including screen printing, spraying, ink jetting, extrusion-die coating, flexographic printing, offset printing, gravure coating, knife coating, brushing, curtain coating, wire-wound rod coating, bar coating and the like provided that a substantially continuous film of the adhesive is provided on the opposing surface of the film, beneath the portions to be printed. Alternatively, the adhesive may be coated onto a release liner and transfer coated onto the support. Further yet, the adhesive may be applied directly to the film and then covered with the support or coated with a coating composition that is suitable for producing a film-like support in-line.

For water-based and solvent-based adhesive compositions, the adhesive is dried after being coated. The coated supports are preferably dried at room temperature for at least 24 hours. Alternatively the coated support may be dried in a heated oven ranging in temperature from about 40° C. to about 70° C. for about 5 to about 20 minutes followed by room temperature drying for about 1 to 3 hours. In the case of 100% solids adhesive compositions such as hot melt adhesive, the composition is cooled and typically conditioned at ambient temperature for at least 24 hours prior to mating with the thin polymer film to be imaged.

Conveniently, suitable supports having pre-applied removable adhesive are commercially available from 3M Company ("3M"), St. Paul Minn. under the product designations "3M Prespacing Tape SCPS-2", "3M Premasking Tape SCPM-3", "3M Premasking Tape SCPM-19", "3M Premasking Tape SCPM-44-X ", and "3M Prespacing Tape SCPS-53X" with "3M Premasking Tape SCPM-3" comprising a preferred removable adhesive.

The support having the preapplied removable adhesive is typically bonded to the film simply by contacting the adhesive coated surface of the support to the film with pressure. Alternatively the manufacturer of the film may provide the film on a support such as a paper liner having the removable adhesive disposed therebetween. This is surmised particularly advantageous for cast or extruded films in order to reduce manufacturing steps.

Suitable films for use in the methods and articles of the invention are preferably comprised of thermoplastic or thermosetting polymeric materials. The polymer films are typically nonporous. However, microporous, apertured, as well as materials further comprising water-absorbing particles such as silica and/or super-absorbent polymers, may also be employed provided the desired print quality can be obtained.

Representative examples of polymer films include single and multi-layer constructions of acrylic-containing films (e.g. poly(methyl) methacrylate [PMMA]), poly(vinyl chloride)-containing films, (e.g., vinyl, polymeric materialized vinyl, reinforced vinyl, vinyl/acrylic blends), poly(vinyl fluoride) containing films, urethane-containing films, melamine-containing films, polyvinyl butyral-containing films, polyolefin-containing films, polyester-containing films (e.g. polyethylene terephthalate) and polycarbonate-containing films. Further, the film may comprise copolymers of such polymeric species. Other particular films include multi-layered films having an image receptive layer comprising an acid- or acid/acrylate modified ethylene vinyl acetate resin, as disclosed in U.S. Pat. No. 5,721,086 (Emslander et al.). The image receptive layer comprises a polymer comprising at least two monoethylenically unsaturated monomeric units, wherein one monomeric unit comprises a substituted alkene where each branch comprises from 0 to about 8 carbon atoms and wherein one other monomeric unit comprises a (meth)acrylic acid ester of a nontertiary alkyl alcohol in which the alkyl group contains from 1 to about 12 carbon atoms and can include heteroatoms in the alkyl chain and in which the alcohol can be linear, branched, or cyclic in nature. A preferred film for increased tear resistance includes multi-layer polyester/copolyester films such as those described in U.S. Pat. Nos. 5,591,530 and 5,422,189.

The films for use in the invention may be clear, translucent, or opaque. Further, the films and imaged articles may be colorless, comprise a solid color or comprise a pattern of colors. Additionally, the film and imaged articles (e.g. films) may be transmissive, reflective, or retroreflective.

If the film composition itself does not provide good adhesion to the intended ink, the film further comprises a primer or ink receptive layer on the surface of the film to be printed. Such ink receptive layer at typically provided at a coating thickness ranging from about 100 angstroms to about 0.5 mils (120,000 angstoms).

Preferred films include polyvinyl fluoride films commercially available from Du Pont, Wilmington, Del. under the trade designation "Tedlar"; acrylic films commercially available from Polymer Extruded Products Inc., Neward, N.J. under the trade designation "Korad", and vinyl films, such as commercially available from 3M Company ("3M"), St. Paul, Minn. under the trade designation "Scotchcal".

For instances wherein the film is to be used as a topfilm in a retroreflective sheeting construction or commercial graphic construction, the film is transparent. That is, when bonded to the viewing surface of a retroreflective substrate, the visible light striking the surface is transmitted through to the retroreflective sheeting and return form the retroreflective substrate back through the top film to the viewer. This property makes the articles particularly useful for outdoor signing applications, in particular traffic control signing systems. Further, the thin polymer film is preferably substantially non-tacky such that the printed image-is resistant to dirt build-up and the like, in the absence of applying a topcoat.

The films as well as the finished article are preferably "durable for outdoor usage" meaning that the film or article to withstand temperature extremes, exposure to moisture ranging from dew to rainstorms, and colorfast stability under sunlight's ultraviolet radiation.

The durability of commercial graphic films can be evaluated according to standard tests, such as ASTM D3424-98, Standard Test Methods for Evaluating the Lightfastness and Weatherability of Printed Matter and ASTM D2244-93 (2000), Standard Test Method for Calculation of Color Differences From Instrumentally Measured Color Coordinates. The commercial graphic constructions (e.g. topfilms) of the invention preferably exhibit less than a 20% change over the lifetime of the product. Commercial graphic films typically have a life span of 1 year, 3 years, 5 years, or 9 years depending on the end-use of the film.

In the case of signage for traffic control, the thin polymer topfilms as well as the articles of the present invention are preferably sufficiently durable such that the articles are able to withstand at least one year and more preferably at least three years of weathering. This can be determined with ASTM D4956-99 Standard Specification of Retroreflective Sheeting for Traffic Control that describes the application-dependent minimum performance requirements, both initially and following accelerated outdoor weathering, of several types of retroreflective sheeting. The coefficient of retroreflection values, both initially and following outdoor weathering, are typically about 50% lower in view on imaged retroreflective substrates.

To enhance durability of the imaged substrate, especially in outdoor environments exposed to sunlight, a variety of commercially available stabilizing chemicals such as heat stabilizers, UV light stabilizers, and free-radical scavengers are typically included in the film, particularly when the film is intended for use as a topfilm in the final product.

The image receiving sheet comprising the film and underlying adhesive and support can be printed with a variety of apparatus to produce graphic images, alphanumeric characters, bar codes and the like. Although the method and articles of the invention are suitable for use with any printing method (e.g. ink jets), the invention is particularly advantageous for methods that employ contact between the film and a printing devise such as a print head or thermal printing methods, particularly thermal mass transfer printing. Contact printing methods include gravure, off-set, flexographic, lithographic, electrographic (including electrostatic), electrophotographic (including laser printing and xerography). Thermal printing is a term broadly used to describe several different families of technology for making an image on a substrate. Those technologies include hot stamping, direct thermal printing, dye diffusion printing and thermal mass transfer printing.

Hot stamping is a mechanical printing system in which a pattern is stamped or embossed through a ribbon onto a substrate, such as disclosed in U.S. Pat. No. 4,992,129 (Sasaki et al.). The pattern is imprinted onto the substrate by the application of heat and pressure to the pattern. A colored material on the ribbon, such as a dye or ink, is thereby transferred to the substrate where the pattern has been applied. The substrate can be preheated prior to imprinting the pattern on the substrate. Since the stamp pattern is fixed, hot stamping cannot easily be used to apply variable indicia or images on the substrate. Consequently, hot stamping is typically not useful for printing variable information, such as printing sheets used to make license plates.

Direct thermal printing was commonly used in older style facsimile machines. Those systems required a special substrate that includes a colorant so that localized heat can change the color of the paper in the specified location. In operation, the substrate is conveyed past an arrangement of tiny individual heating elements, or pixels, that selectively heat (or not heat) the substrate. Wherever the pixels heat the substrate, the substrate changes color. By coordinating the heating action of the pixels, images such as letters and numbers can form on the substrate. However, the substrate can change color unintentionally such as when exposed to light, heat or mechanical forces.

Dye diffusion thermal transfer involves the transport of dye by the physical process of diffusion from a dye donor layer into a dye receiving substrate. Typically, the surface of the film to be printed further comprises a dye receptive layer in order to promote such diffusion. Similar to direct thermal printing, the ribbon containing the dye and the substrate is conveyed past an arrangement of heating elements (pixels) that selectively heat the ribbon. Wherever the pixels heat the ribbon, solid dye liquefies and transfers to the substrate via diffusion. Some known dyes chemically interact with the substrate after being transferred by dye diffusion. Color formation in the substrate may depend on a chemical reaction. Consequently, the color density may not fully develop if the thermal energy (the temperature attained or the time elapsed) is to low. Thus, color development using dye diffusion is often augmented by a post-printing step such as thermal fusing. Alternatively, U.S. Pat. No. 5,553,951 (Simpson et al.) discloses one or more upstream or downstream temperature controlled rollers to provide greater temperature control of the substrate during the printing process.

Thermal mass transfer printing, also known as thermal transfer printing, non-impact printing, thermal graphic printing and thermography, has become popular and commercially successful for forming characters on a substrate. Like hot stamping, heat and pressure are used to transfer an image from a ribbon onto a substrate. Like direct thermal printing and dye diffusion printing, pixel heaters selectively heat the ribbon to transfer the colorant to the substrate. However, the colorant on the ribbon used for thermal mass transfer printing comprises a polymeric binder having a wax base, resin base or mixture thereof typically containing pigments and/or dyes. During printing, the ribbon is positioned between the print head and the exposed surface of the polymer film. The print head contacts the thermal mass transfer ribbon and the pixel heater heats the ribbon such that it transfers the colorant from the ribbon to the film as the film passes through the thermal mass transfer printer.

An example of a representative thermal mass transfer printer is manufactured by Zebra Technologies Corporation, Vernon Hills, Ill. under the trade designation "Model Z170". Suitable ribbons for use in thermal mass printing are also available from Zebra Technologies Corporation under the trade designations "5030", "5099" and "5175". These thermal mass transfer ribbons typically include a backing of polyester about 6 micrometer thick and a layer of colorant about 0.5 micrometers to about 6.0 micrometers thick. Additional information relating to conventional thermal mass transfer printing techniques are set forth in U.S. Pat. No. 5,818,492 (Look) and U.S. Pat. No. 4,847,237 (Vanderzanden).

The printed films along with the underlying removable adhesive and support may be a finished product, such as a banner, or an intermediate in the formation of a finished product. The printed films are useful as a top film for a variety of articles including commercial graphics films and signage such as various retroreflective sheeting products for traffic control, as well as non-retroreflective signage such as backlit signs.

The films are typically mirror image printed and laminated to a substrate using a pressure sensitive adhesive (PSA). The printed area is then buried between the substrate and the thin polymer film. The buried print generally lasts much longer than exposed print because of protection provided by the thin polymer topfilm from environmental attack such as cleaning, sun, abrasion, etc. that would remove the exposed print. Although, burying the print between the substrate and the thin polymer film is preferred, the print may alternatively by exposed, particularly for uses in which durability is not an important factor. Further, a topcoat or additional film may be disposed on the viewing surface, sandwiching the print between the thin polymer film and this additional layer to increase the durability.

Provided that the adhesive does not diminish the intended property of the final product such as being transparent and preferably non-tacky as in the case of topfilms, the adhesive may remain bonded to the thin polymer film. Preferably, however the adhesive is removed concurrently with the removal of the support. Further, it is desirable to strip the support in such a manner that the adhesive coated support can be wound into a roll and be subsequently reused. The substrates to which the printed films are bonded generally provide sufficient strength such that upon removal of the adhesive coated support, the laminate or finished article can be handled for its intended use. Since the article has already been imaged, however, the dimensional stability of the laminate or article may be considerably lower than the thin polymer film in combination with the adhesive coated support, such as in the case of various commercial graphics products wherein the laminate will be adhered to a billboard backing, bus, etc.

The substrate to which the printed thin polymer film may be bonded is typically also a polymeric film, such as those previously described. However, if the substrate is the same composition as that of the thin polymer film, the substrate is generally thicker, ranging in thickness from about 1–2 miles to about 10 mils. Other suitable substrates include woven and nonwoven fabrics, particularly those comprised of synthetic fibers such as polyester, nylon, and polyolefins.

In the case of signage and license plate sheeting, a preferred substrate to which the imaged film may be subsequently bonded is retroreflective sheeting, for example a cube corner sheeting disclosed in U.S. Pat. Nos. 3,684,348, 4,801,193, 4,895,428 and 4,938,563; or a beaded lens sheeting comprising an exposed lens element, encapsulated lenses, or enclosed lenses such as disclosed in U.S. Pat. Nos. 2,407,680, 3,190,178, 4,025,159, 4,896,943, 5,064,272 and 5,066,098.

The article (e.g. printed film) has two major surfaces. The first surface is the "viewing surface", whereas the "opposing surface" is typically a non-viewing surface. The non-viewing surface usually comprises a pressure sensitive adhesive protected by a release liner. The release liner is subsequently removed and the imaged substrate (e.g. sheeting, film) is adhered to a target surface such as a sign backing, license plate backing, billboard, automobile, truck, airplane, building, awning, window, floor, etc.

For embodiments wherein the imaged top film is bonded to a retroreflective substrate, the article is suitable for use as traffic signage, roll-up signs, flags, banners and other articles including other traffic warning items such as roll-up sheeting, cone wrap sheeting, post wrap sheeting, barrel wrap sheeting, license plate sheeting, barricade sheeting and sign sheeting; vehicle markings and segmented vehicle markings; pavement marking tapes and sheeting; as well as retroreflective tapes. The article is also useful in a wide variety of retroreflective safety devices including articles of clothing, construction work zone vests, life jackets, rainwear, logos, patches, promotional items, luggage, briefcases, book bags, backpacks, rafts, canes, umbrellas, animal collars, truck markings, trailer covers and curtains, etc.

Commercial graphic films include a variety of advertising, promotional, and corporate identity imaged films. The films typically comprise a pressure sensitive adhesive on the non-viewing surface in order that the films can be adhered to a target surface such as an automobile, truck, airplane, billboard, building, awning, window, floor, etc. Alternatively, imaged films lacking an adhesive are suitable for use as a banner, etc. that may be mechanically attached to building, for example, in order to display.

Objects and advantages of the invention are further illustrated by the following examples, but the particular materials and amounts thereof recited in the examples, as well as other conditions and details, should not be construed to unduly limit the invention.

EXAMPLES 1–18 AND COMPARATIVE EXAMPLES 1–18

Examples 1–18 were prepared by independently laminating two films to the removable adhesive coated surface of a support commercially available from 3M under the trade designation "3M Premaking Tape SCPM-3". The exposed film surface of the laminate was printed and the print quality assessed.

The first film was 1 mil polyvinyl fluoride film (PVF) primed to be receptive to thermal transfer resin colorants on a 2 mil polyester carrier web, supplied by Du Pont, Wilmington, Del. under the designation "E100950878". The second film was an acrylic film commercially available from Polymer Extruded Products, Inc. Newark, N.J. under the trade designation "Korad 05005" and having a film thickness of 0.002 inch.

The PVF film was fed through a slitter/rewinder apparatus commercially available from Aztech Machinery, Scottsdale, Ariz. under the trade designation "SR4018" where the carrier web was removed from the PVF film and the removable adhesive coated surface of the Premaking Tape SCPM-3 was laminated to the previously carrier web coated surface of the film. For the Korad film, the Premasking Tape SCPM-3 was laminated to one of the surfaces of the film as supplied by the manufacturer.

The laminate prepared from each film was rolled into a 12 inch wide by 500 yards long roll which was then fed through a printer commercially available from Zebra Corp., Veron Hills, Ill. under the trade designation "Z170 XI II" using a ribbon commercially available from Dai Nippon, Japan under the trade designation "R-510".

The Comparative Examples were prepared as described for the corresponding Examples, except without the use of Premasking Tape SCPM-3. For the PVF film Comparative Examples, the carrier web was not removed. The Examples and Comparative Examples were printed using a variety of print head settings as detailed in TABLE II.

After printing, the print quality of each Example and Comparative Example was visually assessed. A portion of the printed film was taken from the roll. The portion was cut into 4–5 sequential pieces, each piece being 3 square inches having 3 test patterns per piece. The test patterns consisted of filled block areas large and small alphanumeric characters as well as down web and cross web bar codes. The pieces were held at arm's length and subjectively rated according to the criteria set out in TABLE I.

TABLE I

| Print Quality Rating (PQR) | Description of the Rating |
|---|---|
| 1 | Very Poor- less than 10% print coverage missing small and large characters; incomplete non readable bar codes; block area incomplete; no usable data was printed |
| 2 | Poor- less than 50% print coverage; missing small characters: some large characters printed; bar codes almost complete, but not readable; block area spotty; some useful data printed |
| 3 | Average- about 90% print coverage, but with some wrinkles, voids and spotting; small characters mostly printed; large characters all printed; bar code thin lines may be incomplete, but mostly readable; block area with larger pin holes and wrinkle lines; data readable other than some small characters |
| 4 | Good- about 99% print coverage with minor spotting; all print good other than small pin holes and some minor leading or trailing edge poor definition; all data readable |
| 5 | Very Good- about 99.9% print coverage with crisp, clean, dark print that was complete and very readable |

Set out in TABLE II are the printer head settings used for each Example and Comparative Example as well as the Print Quality Rating (PQR) from TABLE I.

The data in TABLE II show that under the majority of conditions tested, the presence of the support having the removable adhesive beneath the film being printed improved the print quality by at least one integer according to the Print Quality Rating. Further, the overall printer head energy (i.e. speed and temperature) was considerably lower and yet provided Print Quality Ratings of 3–5. The PVF film construction exhibited a two integer improvement in Print Quality Rating for all conditions, except for Examples 8A, 9A, 14A, 15A, and 18A. The Korad film construction showed a 2 integer improvement for Examples 1B, 2B, 4B, 5B, 10B, 13B and 14B.

Both the PVF film construction and the Korad film construction were also tested at low head pressure which resulted in no improvement in Print Quality Rating compared to the Comparative Example. Overall, medium printer head pressure and temperature were preferred for providing an optimum improvement in Print Quality Rating. These conditions are also surmised to result in an extended duration of print head use before print head replacement.

TABLE II

| Ex. No. and Comp. | Printer Head Settings | | | PQR of Comp. | | PQR of Invention | |
|---|---|---|---|---|---|---|---|
| Ex. No | Pressure | Speed | Temp. | PVF | Korad | PVF | Korad |
| 1A and 1B | Medium | 2 | 24 | 1 | 2 | 3 | 4 |
| 2A and 2B | Medium | 2 | 26 | 2 | 3 | 4 | 5 |
| 3A and 3B | Medium | 2 | 28 | 3 | 5 | 5 | 5 |
| 4A and 4B | Medium | 4 | 24 | 1 | 1 | 3 | 4 |
| 5A and 5B | Medium | 4 | 26 | 1 | 3 | 4 | 5 |
| 6A and 6B | Medium | 4 | 28 | 3 | 4 | 5 | 5 |
| 7A and 7B | Medium | 6 | 24 | 1 | 4 | 3 | 4 |
| 8A and 8B | Medium | 6 | 26 | 2 | 4 | 3 | 4 |
| 9A and 9B | Medium | 6 | 28 | 4 | 5 | 4 | 4 |
| 10A and 10B | High | 2 | 24 | 1 | 1 | 3 | 4 |
| 11A and 11B | High | 2 | 26 | 2 | 4 | 4 | 5 |
| 12A and 12B | High | 2 | 28 | 2 | 5 | 5 | 5 |
| 13A and 13B | High | 4 | 24 | 1 | 1 | 3 | 4 |
| 14A and 14B | High | 4 | 26 | 3 | 3 | 3 | 5 |
| 15A and 15B | High | 4 | 28 | 4 | 4 | 5 | 5 |
| 16A and 16B | High | 6 | 24 | 1 | 3 | 3 | 4 |
| 17A and 17B | High | 6 | 26 | 2 | 5 | 4 | 5 |
| 18A and 18B | High | 6 | 28 | 3 | 5 | 4 | 5 |

1. Elastic Modulus

The elastic modulus of the dimensionally unstable film and the removable adhesive layer employed in the examples was determined with the following test method.

A sample, having dimensions no greater than 1"×1" by ½ inches in thickness, was mounted on a 2 inch diameter aluminum cylinder which serves as a fixture in the Nanoindenter XP (MTS Systems Corp. Nano Instruments Division, Oak Ridge, Tenn.). For all experiments a diamond Berkovich probe (also available from MTS Systems Corp.) was used. The nominal loading rate was set at 10 nm/s with spatial drift setpoint set at 0.05 nm/s maximum. A constant strain rate experiment at 0.05/s to a depth of 200 nm was used. The layer to be characterized was located as seen top-down as viewed through a video screen with 100× magnification. The test regions were selected locally with 100×video magnification of the XP to insure that tested regions are representative of the desired sample material, i.e. free of voids, inclusions, or debris. Furthermore, microscope optical axis-to-indenter axis alignment is checked and calibrated previous to testing by an iterative process where test indentations are made into a fused quartz standard, with error correction provided by software in the XP.

The sample surface is located via a surface find function where the probe approaches the surface with a spring stiffness in air which changes significantly when the surface is encountered. Once the surface is encountered, load-displacement data is acquired as the probe indents the surface. This data is then transformed to Hardness and Elastic Modulus material properties based on the methodology described below. The experiment is repeated in different areas of the sample so that a statistical assessment can be made of the mechanical properties.

The Elastic Modulus determined directly from the load-displacement data is a composite Modulus, i.e. the Modulus of the XP Indenter Tester-to-sample mechanical system. The composite Modulus for these load-displacement indentation experiments can be determined from:

$S=2/SQRT(Pi)*F*SQRT(A)$ where

S—contact stiffness, determined via the MTS XP's patented Continuos-Stiffness-Method, by solving the differential equation relating a periodic forcing function F(t,w)=m d^2x/dt^2+k x+b dx/dt to the coefficients of the rheological sample-indenter mechanical system, i.e. the in-phase and out-of-phase components of the displacement response to the forcing function, yield the in-phase spring constant K, (thus the stiffness—hence contact area), and out of phase damping coefficient, b. The default excitation frequency for these tests is 45 hz;

A—area of contact [m^2], assuming that the indentation replicates the shape of the indenter during indentation, the indenter geometry is modeled via analytic geometry so that the projected area, A=h^2+higher order terms where h—displacement depth, and higher order terms are empirically measured;

F—Composite Modulus [GPa]

Then the sample material's Elastic Modulus (E) is obtained from:

$1/F=(1-u^2)/K+(1-v^2)/E$ where u—Poisson Ratio of diamond indenter=0.07

K—Elastic Modulus of diamond indenter=1141 GPa v—Poisson Ratio of samples

A Poisson's Ratio of 0.4 is assumed for these polymeric specimens, while 0.18 for the calibration standard is entered into the algorithm for determining Elastic Modulus.

The "Korad 05005 had an elastic modulus of 0.86 GPa, whereas the removable adhesive of the "3M Premasking Tape SCPM-3" has an elastic modulus of 0.2 GPa.

What is claimed is:

1. A method of printing comprising:

a) providing an image receiving sheet comprising a film having an exposed surface and an unexposed surface, a dimensionally stable support, and an adhesive disposed between said unexposed surface of the film and the support;

b) printing the exposed surface of the film;

c) bonding the exposed surface of the film to a substrate; and d) removing the support concurrently with removing the adhesive.

2. The method of claim 1, wherein the method of printing is contact printing.

3. The method of claim 1, wherein the method of printing is thermal printing.

4. The method of claim 2, wherein the method of printing is thermal mass printing.

5. The method of claim 1, wherein the minted surface exhibits a print quality improvement of by at least one integer in comparison to the film without the adhesive exposed according to the Print Quality Rating Scale.

6. The method of claim 1, wherein the printed surface exhibits a print quality improvement of by at least two integers in comparison to the film without the adhesive exposed according to the Print Quality Rating Scale.

7. The method of claim 1, wherein the film is selected from acrylic-containing films, poly(vinyl chloride)-containing films, poly(vinyl fluoride) containing films, urethane-containing films, melamine-containing films, polyvinyl butyral-containing films, polyolefin-containing films, polyester-containing films and polycarbonate-containing films.

8. The method of claim 1, wherein the film is transparent.

9. The method of claim 8, wherein the substrate is transmissive, reflective or retroreflective.

10. The method of claim 8, wherein the printed film is mirror imaged and the film provides a protective topfilm.

11. The method of claim 1, further comprising an ink or dye receptive layer on the exposed surface of the film.

12. The method of claim 1 wherein the film exhibits a print quality of less than 3 according to the Print Quality Rating Scale.

13. The method of claim 12 wherein the printed surface exhibits a print quality improvement of at least one integer greater than the film without the adhesive exposed.

14. The method of claim 1 wherein the support is substantially free of a release coating.

15. The method of claim 1 wherein the support is a polymeric film ranging in thickness from about 1 mil to about 10 mils.

16. The method of claim 1 wherein the support is paper.

17. The method of claim 1 wherein the support is provided with preapplied adhesive.

18. The method of claim 1 wherein the adhesive can be removed without damaging the printed film.

* * * * *

UNITED STATES PATENT AND TRADEMARK OFFICE

CERTIFICATE OF CORRECTION

PATENT NO. : 6,712,532 B2
DATED : March 30, 2004
INVENTOR(S) : Look, Thomas F.

It is certified that error appears in the above-identified patent and that said Letters Patent is hereby corrected as shown below:

Column 7,
Line 6, delete “image-is” and insert -- image is --, therefor.

Column 11,
Table 1, line 26, delete “:” and insert -- ; --, therefor.

Column 14,
Line 8, delete “minted” and insert -- printed --, therefor.
Line 9, and 13, after “of” delete “by”.

Signed and Sealed this

Twenty-fifth Day of May, 2004

JON W. DUDAS
*Acting Director of the United States Patent and Trademark Office*